US007494568B2

(12) United States Patent
Ogiwara

(10) Patent No.: US 7,494,568 B2
(45) Date of Patent: Feb. 24, 2009

(54) LEADER CLOTH AND MANUFACTURING METHOD THEREOF

(75) Inventor: Yasuyuki Ogiwara, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 432 days.

(21) Appl. No.: 11/352,266

(22) Filed: Feb. 13, 2006

(65) Prior Publication Data

US 2006/0180290 A1 Aug. 17, 2006

(30) Foreign Application Priority Data

Feb. 14, 2005 (JP) ..... 2005-035790

(51) Int. Cl.
*D21F 7/00* (2006.01)

(52) U.S. Cl. ..... 162/273; 162/200; 162/197; 162/199; 428/99; 34/120

(58) Field of Classification Search ..... 162/273, 162/200, 197, 199; 428/99; 426/131, 192; 34/120
See application file for complete search history.

(56) References Cited

U.S. PATENT DOCUMENTS 5,306,393 A 4/1994 Rhyne
6,398,915 B1 * 6/2002 Fargeout ..... 162/273

FOREIGN PATENT DOCUMENTS

| | | |
|---|---|---|
| JP | 08-284092 | 10/1996 |
| JP | 2003-502530 | 1/2003 |
| JP | 2003-514131 | 4/2003 |
| WO | 00/79048 | 12/2000 |
| WO | 01/32981 | 5/2001 |

* cited by examiner

*Primary Examiner*—Mark Halpern
(74) *Attorney, Agent, or Firm*—Wenderoth, Lind & Ponack, L.L.P.

(57) ABSTRACT

A leader cloth for pulling and installing a belt body onto rolls in a paper machine able to pass between rolls with a small clearance and capable of preventing sag or deflection. At a position near the base portion and a position closer to the apex portion of the leader cloth, stabilizers of a rope or belt-like shape are attached in the width direction to opposite surfaces. Preferably, a sticking fastener is used for the stabilizers The rear face of one piece of the sticking fastener is attached on the surface of the leader cloth by means of stitching to expose sticking face (L-like shaped hooks or loops). The sticking face of the other piece of the sticking fastener is forcefully pressed against the first while applying a tensile force in the width direction to stick the two pieces to each other.

5 Claims, 1 Drawing Sheet

LEADER CLOTH AND MANUFACTURING METHOD THEREOF

BACKGROUND OF THE INVENTION

1. Technical Field

The present invention relates to a leader cloth for pulling a new belt into a paper machine and laying the leader cloth onto rolls when replacing a cloth or belt (referred to as a belt hereinafter) for the paper machine.

2. Background Art

In a paper machine for making paper, a belt which has extremely large width, length and weight, is laid onto the rolls, and processes such as squeezing water, conveying, drying are carried out on wet paper while the belt travels on the rolls.

When the belt functions have remarkably degraded, the belt is replaced with a new belt. In doing so, the following are required: the machine has to be stopped; the used belt has to be removed; and then, a new belt has to be laid therein. Since the belt is large in size and heavy, in order to carry out the replacing work safely and effectively, the following method has been conventionally employed. A used endless belt (referred to as old belt hereinafter) installed on the rolls is cut off in the width direction first. Then, the rear end of the old belt is joined to the front end portion of a new belt. The old belt is driven to travel in the front end portion direction to pull the new belt into the paper machine. After the new belt is laid onto the entire rolls, both ends of the belt are sewed together to form an endless belt on the rolls. However, in the above method, it is hard to remove the belt. The damaged used belt may be occasionally broken off while replacing the same with a new belt, and it takes a lot of trouble to gradually remove the leading used belt out of the paper machine while pulling the new belt into the paper machine. Therefore, now, after removing the old belt, a rope is laid onto the rolls in the paper machine, a new belt is connected to the rope, and the new belt is pulled onto the rolls in the paper machine by pulling the rope.

To guide the new belt onto the rolls smoothly and precisely as described above, the following method has been employed. A fabric called leader cloth is connected to the rear end portion of the rope. The leader cloth is connected to the end portion of the new belt, and the tensile force by traction via the rope is transmitted to the new belt via the leader cloth to pull the same onto the rolls.

To achieve the above object, leader clothes with various configurations and structures have been proposed. For example, the followings are known. In U.S. Pat. No. 5,306,393 (Patent Document 1), a leader cloth is disclosed having a structure of a fabric of a rectangular shape and a plurality of ropes, the ropes being fixed to the fabric by use of a plurality of grommets provided in the end portion thereof at uniform intervals. The ropes are bundled and hooked on a ring, and are pulled with another rope via the ring. In Translated National Publication of Patent Application No. 2003-502530 (Patent Document 2), a leader cloth is disclosed having a structure wherein three pieces of rectangular-shaped materials for forming a triangular shape are laminated In Translated National Publication of Patent Application No. 2003-514131 (Patent Document 3), a leader cloth is disclosed having a substantially triangular shaped base material coated with polymer and reinforced with wires.

The leader cloth has a configuration as follows. In one end thereof, an apex portion is formed in the direction where the leader cloth is pulled onto the rolls in the paper machine, and a connecting member for connecting to a rope is provided in the apex portion of the leader cloth. The other end is the base portion having the same width as that of the belt, being connected to a new belt. The leader cloth is a wide cloth with a maximum width of over ten meters. Therefore, there is such a possibility that, while traveling, the leader cloth may generate sag and/or deflection causing a crease or fold when the leader cloth is pulled into the paper machine. In order to eliminate the deflection and to stabilize the leader cloth, ordinarily, in the end portion of the leader cloth, a steel pipe or an iron plate is attached in the width direction thereof as a stabilizer.

For example, in Japanese Patent Application Laid-Open No. Hei 8-284092 (Patent Document 4), a strip of cloth having the same width as that of a belt body 101, which is folded and covers the top and bottom face of a front-end portion of the belt body as shown in FIG. 2, is used as a leader cloth 102. The area closer to the turn edge 103 is stitched at a seam 104 and the loose edges thereof are flaps 106*a* and 106*b*. The belt body and the leader cloth are temporarily connected to each other with a temporary connecting portion (not shown). In a leader cloth having the structure as described above, a sack portion 105 is formed between the turn edge 103 and the seam 104. A core rod 107 of a wood, plastic or metal is inserted into the closed portion to reinforce the end portion of the leader cloth. The leader cloth attached with such a steel pipe is pulled onto the rolls via tow ropes 108.

[Patent Document 1] U.S. Pat. No. 5,306,393

[Patent Document 2] Translated National Publication of Patent Application No. 2003-502530

[Patent Document 3] Translated National Publication of Patent Application No. 2003-514131

[Patent Document 4] Japanese Patent Application Laid-Open No. Hei 8-284092

BRIEF SUMMARY OF THE INVENTION

Problem to be Solved by the Invention

However, it is not easy for a leader cloth with a steel pipe or an iron plate attached to a front-end portion to pass through a narrow clearance between rolls when pulled into a paper machine. Problems sometimes occur while replacing a belt.

Also, in the leader cloth disclosed in patent documents 2 and 3, in a base portion to which a new belt is connected, the both ends thereof sag down due to its own weight causing a positional displacement in the width direction, and twist or deflection of the belt is generated while being laid onto the rolls. Thus, a work to lay the belt onto the rolls has been obstructed.

Means for Solving the Problem

The inventor of the present invention examined the structure of a stabilizer, which is capable of passing through even a narrow clearance between the rolls freely and stably without causing any displacement of the belt end portion, twist, deflection or the like, and is further capable of preventing sag and/or deflection of the leader cloth. As a result, it was found that the above object could be achieved by attaching a rope or belt to the end portion of the leader cloth in a well-balanced manner.

That is, the present invention is a leader cloth for pulling and installing a belt body onto rolls in a paper machine including stabilizers having a rope or belt-like shape, wherein the stabilizers are attached to the leader cloth in the width direction thereof at a position near the base portion and a position closer to the apex portion, and each of the stabilizers is attached to an opposite surface thereof.

Also, the present invention provides a manufacturing method of a leader cloth, which generates little sag or crease by using a sticking fastener as stabilizers.

EFFECT OF THE INVENTION

According to the present invention, stabilizers of a rope or belt-like shape are attached at a position near the base portion and a position closer to the apex portion of the leader cloth on the both surfaces thereof. Therefore, the leader cloth does not cause any problem in passing through the rolls when pulled into the paper machine, unlike the case of a leader cloth with a steel pipe inserted therein. Accordingly the leader cloth can easily pass through between the rolls even with a narrow clearance therebetween.

That is, since the rope or belt used as the stabilizer in the present invention is pliable and flexible compared to the steel pipe, less resistance is applied to the leader cloth when the leader cloth passes between the rolls. Also, since the stabilizers are attached to the leader cloth at a position near the base portion and a position closer to the apex portion on the both surfaces thereof, no sag or crease is generated on the leader cloth while the leader cloth is pulled into the paper machine. Moreover, the function as a stabilizer is not inferior to the metal rod or the like.

Further, the ropes or belts attached to both of the front and rear surfaces of the leader cloth are separately disposed with a gap from each other in the longitudinal direction. Therefore, the thickness of the portion attached with the stabilizer is small, and the leader cloth can easily pass through the clearance between the rolls.

In the present invention, one of the two stabilizers attached to the leader cloth has to be attached to the front surface thereof and the other has to be attached to the rear surface thereof. The reason is as follows. When a stabilizer is attached to the front surface of the leader cloth, a bending stress is generated toward the rear surface like a bimetal. In order to offset the bending stress, the other stabilizer has to be attached to the opposite surface so as to preserve the balance with each other, whereby the leader cloth is prevented from warping and, thus, the leader cloth is prevented from generating sag and/or crease in passing between the rolls when pulled into the paper machine.

As described above, the leader cloth attached with the stabilizers according to the present invention easily passes through the rolls when pulled into the paper machine, and the belt can be replaced smoothly.

BEST MODE FOR CARRYING OUT THE INVENTION

The leader cloth according to the present invention is applicable to the leader cloths cited in the Patent Documents 1 to 4 and to other arbitrary types of leader cloth.

Figure 1:
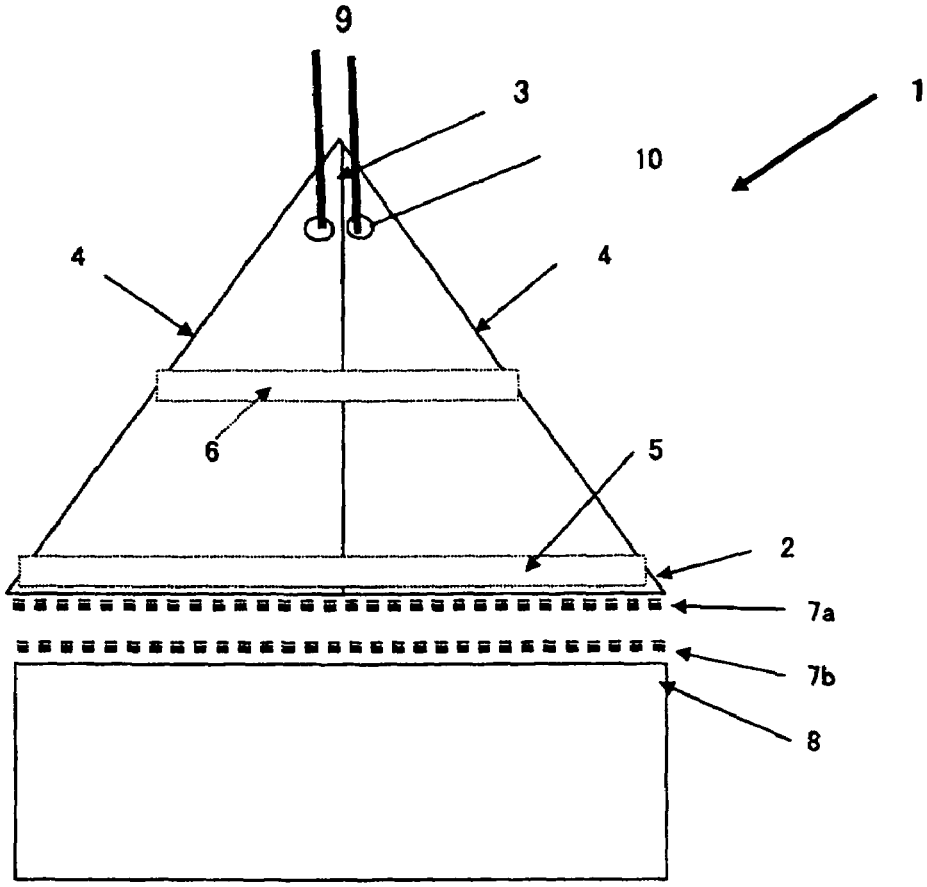
FIG. 1 A plan view of a leader cloth in accordance with the present invention.
Figure 2:
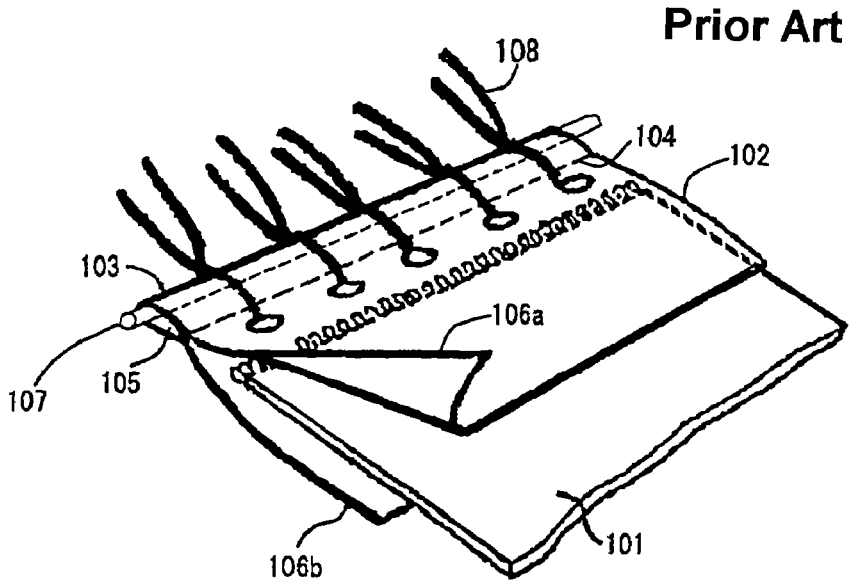
FIG. 2 A perspective view of a conventional leader cloth.

Hereinafter, referring to the drawings, a leader cloth according to the present invention will be described. FIG. 1 is a plan view of a leader cloth according to the present invention. A leader cloth 1 shown in FIG. 1 has a chevron-like configuration formed by a base portion 2, an apex portion 3, and side edge portions 4.

A stabilizer 5 is attached to the front surface of the leader cloth shown in FIG. 1 along the full width of the base portion 2. A stabilizer 6 is attached on the rear surface across the full width thereof at an intermediate position between the base portion 2 and the apex portion 3; i.e., at a position substantially a half of the length of a perpendicular line drawn from the apex portion 3 to the base portion 2.

By balancing the installation tensile force between the stabilizers 5 and 6 attached to the both surfaces of the leader cloth, the leader cloth 1 can prevent sag, deformation or crease from occurring in the base portion.

When laying a new belt onto the rolls, the leader cloth having stabilizers attached thereto is connected and temporarily fixed to the end portion of the new belt body so that the leader cloth may be removed therefrom after the new belt is laid on the rolls. As for the method of temporary fixing, stitching or the following method is employed. That is, a fastener piece 7*a* is attached to the base portion 2 of the leader cloth, and by using another fastener piece 7*b*, the end portion 8 of the new belt is attached to the leader cloth.

When replacing the belt, tow ropes 9 are attached for pulling the belt onto the rolls in the paper machine. A plurality of holes 10 for tying the rope are formed in the vicinity of the apex portion of the leader cloth, and ropes are tied thereto.

To install the new belt into the paper machine, the end portion 8 of the new belt is temporarily connected to the leader cloth using the fasteners and temporary connecting portion. On the other hand, a tow rope 9 attached to the front end portion of the leader cloth is laid in the paper machine, and is driven to turn around between the rolls along the traveling direction of the belt. Whereby, the new belt is pulled into the paper machine being guided by the leader cloth. In the leader cloth according to the present invention, since the stabilizers are attached to both surfaces thereof, no crease or break due to deflection or sagging is generated when the leader cloth is pulled into the paper machine. Also, since the rope or belt used for the stabilizer is pliable and flexible, and the stabilizers attached to both surfaces are separately disposed with a gap from each other in the longitudinal direction, the leader cloth is allowed to easily pass through the clearance between the rolls.

When the new belt travels around the entire rolls and both ends thereof come close to each other, the leader cloth is disconnected from the new belt. The ends of the new belt are joined to each other by stitching or the like. Thus, the installation of the new belt is completed.

Since a material of the leader cloth has to bear the force pulling the extremely heavy belt, a highly strong cloth is required, and a cloth of synthetic or natural fiber fabric; for example, polyamide or polyester fabric, or a nonwoven cloth or the like using various materials is employed. The materials may be subjected to water repellent finish to prevent the material from being degraded due to permeation of water.

As for the material for the rope or belt as the stabilizer, a net yarn or braid of a synthetic fabric, or a band-like material, particularly, a sticking fastener is preferred. The sticking fastener is a fastener available from the market named "magic tape" (registered trade mark) or the like. The sticking fastener is composed of a pair of tapes, each of which has a sticking surface having L-like shaped hooks or loops on the respective surfaces. After stitching a piece of the sticking fastener to the leader cloth, the other piece is attached thereto; thus, the stabilizer is formed on the leader cloth.

As for the thickness of the rope, 2 to 20 mm in diameter, in particular, 5 to 10 mm in diameter is preferred. Moreover, when a belt or a sticking fastener is used, the belt or sticking fastener is preferably 2 to 20 mm, in particular, 5 to 10 mm in thickness; and 10 to 100 mm, in particular, 20 to 50 mm in width.

As for the position of the stabilizers to be attached, a position for one stabilizer is in the vicinity of the base portion, the position for the other stabilizer is closer to the apex portion, and each of the stabilizers is attached to the opposite surface of the leader cloth at the respective positions. As for the position in the vicinity of the base portion, a position where the lower end portion of the stabilizer is nearly coincident with the lower end portion of the base portion, or a position which is closer to the apex portion by 5 mm to 50 mm therefrom is preferred. As for the position of the other stabilizer to be attached, a position closer to the apex portion by 100 mm to 200 mm from the center position of the stabilizer in the vicinity of the base portion, or an intermediate position from the base portion to the apex portion. If the distance between the stabilizers is too small, there arises a problem when the stabilizers pass through the rollers; on the other hand, when the distance is too large, the effect of the attached stabilizer to offset the bending force toward the rear face is reduced.

The stabilizers having a rope or belt-like shape are attached to the cloth in a manner of stitching or the like. Particularly, when a sticking fastener is used as the stabilizer, the rear face of one piece of the sticking fastener is attached on the surface of the leader cloth by means of stitching beforehand to expose the sticking face of the sticking fastener (L-like shaped hooks or loops) to the outside. Then, the sticking face of the other piece of the sticking fastener (loops or L-like shaped hooks) is firmly pressed against the sticking face of the one piece while giving a tensile force in the width direction to stick the two pieces with each other. By carrying out the above steps with both stabilizers, attaching stabilizers is completed. Sticking fasteners as described above can prevent sag, deformation or creases in the base portion of the leader cloth.

Further, in order to increase the strength of the leader cloth, one or more reinforcing wires of a high-molecular compound may be appropriately provided to the cloth for reinforcing. As for the material for the reinforcing wires, a high-molecular compound such as polyester, polyamide, polyethylene, polypropylene, polyurethane, polystyrene, epoxy resin, polyvinyl chloride or polycarbonate is employed, and these are used after forming as a wire. The reinforcing wires may be provided in the longitudinal or lateral direction, in the directions along the side edge portions, or in multiple directions in combination of the above.

INDUSTRIAL APPLICABILITY

The present invention provides a leader cloth as the guide member for installing a new belt in a paper machine, in which a material and a structure of a stabilizer are improved for eliminating sag or deflection while traveling.

According to the present invention, stabilizers of a rope or belt-like shape are attached respectively to the leader cloth in the width direction at a position near the base portion of the leader cloth and a position closer to the apex portion, and each of the stabilizers is attached to an opposite surface thereof. By fixing of such a stabilizers, no sag or crease of the leader cloth is generated. The belt can easily pass between rolls with small clearance when the belt is pulled into the paper machine while carrying the replacing work of the belt. Thus, the replacing work of the belt is carried out smoothly with no trouble.

The invention claimed is:

1. A leader cloth for pulling and installing a belt body onto rolls in a paper machine, said leader cloth comprising:

a leader cloth, having an apex portion, for pulling the leader cloth, and a base portion, for attaching to a belt body;

a first stabilizer having a rope or belt-like shape, said first stabilizer being attached to a first surface of said leader cloth along a width direction thereof and at a position near said base portion; and a second stabilizer having a rope or belt-like shape, said second stabilizer being attached to a second surface of said leader cloth opposite to said first surface, along a width direction thereof and at a position closer than said first stabilizer to said apex portion.

2. The leader cloth according to claim 1, wherein said first stabilizer and said second stabilizer each comprise a two-sided hook-and-loop type fastener.

3. The leader cloth according to claim 2, wherein a first side of said first stabilizer is stitched to said leader cloth, said first side of said fastener of said first stabilizer being for attaching to a second side of said first stabilizer, and wherein a first side of said hook-and-loop type fastener of said second stabilizer is stitched to said leader cloth, said first side of said second stabilizer being for attaching to a second side of said second stabilizer.

4. The leader cloth according to claim 1, wherein said first stabilizer and said second stabilizer are configured to prevent sag of said leader cloth.

5. A method for manufacturing a leader cloth, said method comprising:

stitching a first side of a first hook-and-loop type fastener to a surface of a leader cloth along a width direction at a position near a base portion of the leader cloth, the first side of the first fastener being for applying a longitudinal tension to and attaching a second side of the first fastener;

stitching a first side of a second hook-and-loop type fastener to a surface of the leader cloth opposite to the first fastener, along a width direction thereof at a position closer than the first fastener to an apex portion of the leader cloth, the first side of the second fastener being for applying a longitudinal tension to and attaching a second side of the second fastener.

* * * * *